US006791045B1

(12) United States Patent
Yamamoto et al.

(10) Patent No.: US 6,791,045 B1
(45) Date of Patent: Sep. 14, 2004

(54) SHIELDED-TYPE AUTOMOTIVE RELAY CONTROLLING A MAGNET CLUTCH LOAD OF A VEHICLE AIR-CONDITIONER

(75) Inventors: Toshiya Yamamoto, Kanagawa (JP); Kiyokazu Kojima, Kanagawa (JP); Osamu Sakaguchi, Kanagawa (JP); Kunihiro Shima, Kanagawa (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 0 days.

(21) Appl. No.: 09/701,379

(22) PCT Filed: Jul. 7, 2000

(86) PCT No.: PCT/JP00/04541

§ 371 (c)(1),
(2), (4) Date: Nov. 30, 2000

(87) PCT Pub. No.: WO01/04368

PCT Pub. Date: Jan. 18, 2001

(30) Foreign Application Priority Data

Jul. 7, 1999 (JP) ..... 11/227881

(51) Int. Cl.[7] ..... C22C 5/06; H01H 1/02

(52) U.S. Cl. ..... 200/275; 252/514; 252/520.1; 335/151; 148/431; 420/501

(58) Field of Search ..... 200/275; 252/514, 252/520.1; 335/151; 148/431; 420/501; C22C 5/06

(56) References Cited

U.S. PATENT DOCUMENTS 3,933,485 A 1/1976 Shibata ..... 75/173
4,243,413 A * 1/1981 Shibata ..... 75/234
5,198,015 A * 3/1993 Tsuji et al. ..... 75/247

FOREIGN PATENT DOCUMENTS

| | | |
|---|---|---|
| JP | 61-61310 | 3/1986 |
| JP | 63-152447 | 6/1990 |
| JP | 05-182544 A * | 7/1993 |
| JP | 8-161954 | 6/1996 |
| JP | 9-134632 | 5/1997 |

* cited by examiner

*Primary Examiner*—George Wyszomierski
*Assistant Examiner*—Janelle Combs Morillo
(74) *Attorney, Agent, or Firm*—Rothwell Figg Ernst & Manbeck

(57) ABSTRACT

The invention is directed to an electric contact material useful in the fabrication of a vehicle relay of high durability against inductive load to which the relay incorporated in a magnetic clutch of a vehicle air-conditioner is exposed, and also to a relay having remarkable durability as has never been attained for use in vehicles. The invention provides an electric contact material useful in the fabrication of a relay for use in a vehicle, wherein the material contains an Ag—$SnO_2$—$In_2O_3$ alloy which is produced through internal oxidation of an Ag—Sn—In—Ni alloy containing 5.0–10 wt. % (as reduced to metal) Sn and 2.0–5.0 wt. % In, the balance being Ag {or alternatively, an Ag—$SnO_2$—$In_2O_3$—NiO alloy which is produced through internal oxidation of an Ag—Sn—In—Ni alloy containing 5.0–10 wt. % (as reduced to metal) Sn, 2.0–5.0 wt. % In, and 0.01–0.50 wt. % Ni, the balance being Ag}, and is used in a shielded space.

2 Claims, 2 Drawing Sheets

SHIELDED-TYPE AUTOMOTIVE RELAY CONTROLLING A MAGNET CLUTCH LOAD OF A VEHICLE AIR-CONDITIONER

TECHNICAL FIELD

The present invention relates to an electric contact material useful in the fabrication of a relay for use in vehicles, the relay being highly durable against load exerted by a magnetic clutch of a vehicle air-conditioner. The invention also relates to such a relay for use in vehicles.

BACKGROUND ART

An electric contact element which makes and breaks an electric circuit is generally called an electric contact. The electric contact must allow current (signal) flow via the contact through contact between metal parts. In addition, the electric contact must completely break the circuit upon breaking of contact.

Although an electric contact per se has a simple structure, a variety of physical and chemical phenomena are known to occur at a contact surface thereof. For example, there occur adsorption, oxidation, sulfidation, and formation of organic compounds, and concomitant discharge, melting, evaporation, wear, and transfer. Such phenomena are very complex, and as a result, the phenomena have not yet been completely elucidated in studies thereon.

The occurrence of such phenomena adversely affects the function of the electric contact, in some cases leading to inhibition of the contact function (for example, the contact portions become welded together). Loss of the contact function is detrimental to the performance and service life of the electrical appliance into which such an affected electric contact is incorporated. Therefore, an electric contact is one of the important parts for determining the service life and performance of an electrical appliance.

In recent years, remarkable developments in the field of electronics and electrical engineering have made a broad range of appliances employing electric contacts available; i.e., from light electrical appliances such as apparatuses for telecommunications and electronics to heavy electrical appliances such as large-current choppers. Since the functions required vary depending on use, electric contacts having characteristics suited to various end uses have been developed. In fact, a large variety of such apparatuses are commercially available.

The existing techniques related to the types of electric contacts according to the present invention; i.e., those contacts used in relays and switches for use in vehicles, will next be described. An electric contact element which is to be used in relays and switches is called a make-and-break contact. The electric contact material for producing such a make-and-break contact is particularly required to have wear resistance and transfer resistance in order to maintain a stable make-and-break mechanism, and to have low contact resistance in order to maintain stable contact conditions.

Examples of electric contact materials conventionally employed for fabricating relays and switches for use in vehicles include Ag—Cu alloys (1–25 wt. % Cu, the balance being Ag), Ag—$SnO_2$ alloys (5–15 wt. % $SnO_2$, the balance being Ag), and Ag—$SnO_2$—$In_2O_3$ alloys.

These electric contact materials may be used by themselves in unmodified form. However, usually, these materials are formed into a clad rivet contact in which two to three contact layers are laminated on a Cu or Cu alloy layer serving as a substrate layer or into a clad crossbar contact in which two to five contact layers are laminated on a Cu or Cu alloy layer serving as a substrate layer. The clad rivet contact and the clad crossbar contact are useful in the fabrication of a relay, in which an electric contact can make and break electric contact by the action of a movable iron plate which is brought into contact to a counterpart through a magnetic force produced by applying an electric current (signal) such as direct current, alternating current, or impulses to a coil in order to generate magnetic flux.

When exposed to direct-current loads in vehicles, the aforementioned conventional electric contact materials are satisfactory at a practical level in terms of wear resistance, transfer resistance, and low contact resistance. However, the following problems have been identified. Firstly, these electric contact materials do not meet demand for the smaller-sized parts of vehicles. As the functionality and performance of vehicles has increased, the number of electric parts used in vehicles has also increased, but the size of the electric parts themselves has decreased. In addition, size reduction has been performed also in consideration of cost reduction. Although there is demand for size reduction of relays and switches themselves, the aforementioned conventional electric contact materials do not lend themselves to this purpose.

Briefly, when the volume of an electric contact material decreases so as to reduce the size of a relay, the work per unit volume of the material increases greatly during the making and breaking of contact. Thus, a conventional electric contact material undergoes self-welding only after a short period of operation.

Secondly, in recent years, in addition to size reduction, there is also demand for extending the range of applications and for extending the service life of relays and switches for use in vehicles. Regarding extending the range of applications, there is demand for electric contact materials which can generally be suited for operation of a variety of loads; e.g., lamp loads where there is a flow of inrush current (head lamps and discharge lamps), resistance loads (rear defogger), and solenoid loads in which long-term arc generation occurs (magnetic clutch).

Regarding the extension of service life, there are needed electric contact materials which can be operated for a long period of time even when the electric appliance is used in a novel operational mode. For example, operation of a vehicle air-conditioner has undergone various changes. Previously, vehicle air-conditioners were usually operated only in summer. However, recently, air-conditioners have been operated throughout the year as automatically-controllable air-conditioners. Consequently, operational frequency and the operation period of relays and switches to control the air-conditioners has increased correspondingly. Thus, there is a requirement for electric contact material useful in the fabrication of make-and-break contacts to satisfy the above conditions.

Examples of relays which are currently and typically used in vehicles include an ISO (International Standardization organization) relay, a mini-ISO relay, and a micro-ISO relay. By employing Ag material such as Ag—$SnO_2$ or Ag—$SnO_2$—$In_2O_3$ to fabricate such relays, a considerable reduction in size has already been attained. However, currently employed relays used to control a magnetic clutch of a vehicle air-conditioner are not sufficiently durable. At present, simultaneous extension of both the applications and the service life of the above relays has not yet been attained.

Specifically, an open-type relay is employed as a vehicle relay for controlling a magnetic clutch which exerts an inductive load (50W) on a vehicle air-conditioner. Currently, an open-type relay has attained a durability equal to approximately 400,000 cycles of make-and-break operation. Thus, there is a further need for a relay, for use in vehicles, having a durability equal to at least 1,000,000 cycles of make-and-break operation so as to suit the relay for the aforementioned increased frequency of make-and-break operations.

The present invention has been accomplished in consideration of the foregoing. Accordingly, the invention is directed to an electric contact material useful in the fabrication of a vehicle relay of high durability against inductive load to which the relay incorporated in a magnetic clutch of a vehicle air-conditioner is exposed, and also to a relay having remarkable durability as has never been attained for use in vehicles.

DISCLOSURE OF THE INVENTION

In order to solve the aforementioned problems, the present inventors have conducted extensive studies and experiments on the composition of electric contact material for controlling a magnetic clutch (i.e., an inductive load) of a vehicle air-conditioner and the circumstances under which the contact material is used, and have developed a relay for use in vehicles as described below.

Accordingly, as described in claim 1, there is provided an electric contact material useful in the fabrication of a relay for use in a vehicle, the relay controlling a magnetic clutch (i.e., a load) of a vehicle air-conditioner, wherein the material comprises an Ag—$SnO_2$—$In_2O_3$ alloy which is produced through internal oxidation of an Ag—Sn—In alloy containing 5.0–10.0 wt. % (as reduced to metal) Sn and 2.0–5.0 wt. % In, the balance being Ag, and is used in a shielded space.

As recited in claim 2, there is provided an electric contact material useful in the fabrication of a relay for use in a vehicle, the relay controlling a magnetic clutch (i.e., a load) of a vehicle air-conditioner, wherein the material comprises an Ag—$SnO_2$—$In_2O_3$—NiO alloy which is produced through internal oxidation of an Ag—Sn—In—Ni alloy containing 5.0–10.0 wt. % (as reduced to metal) Sn, 2.0–5.0 wt. % In, and 0.01–0.50 wt. % Ni, the balance being Ag, and is used in a shielded space.

The electric contact materials according to the present invention useful in the fabrication of a relay for use in a vehicle, the relay controlling a magnetic clutch (i.e., a load) of a vehicle air-conditioner, have remarkably increased the durability during operation of a magnetic clutch (i.e., an inductive load) of a vehicle air-conditioner. In addition, the electric contact materials exhibit durability equal to that which has conventionally been attained during the operation of other loads in vehicles, such as vehicle lamps. Thus, the material sufficiently is suited to long-term operation and application in a small device.

In general, electric contact material useful in the fabrication of a relay for use in vehicles, such as a micro-ISO relay, is used while the material is in contact with airs i.e., is used in an open system. However, the present inventors have investigated the composition of electric contact material useful in the fabrication of a relay for use in vehicles such as a micro-ISO relay and the circumstance under which the material is used, and have found that the electric contact material as recited in claim 1 or 2 in a shielded space attains a durability at least twice that of the conventional electric contact material useful in the fabrication of a relay for use in vehicles, the relay controlling a magnetic clutch (i.e., load) of a vehicle air-conditioner.

The present inventors have recognized the reason why the electric contact material useful in the fabrication of a relay for use in vehicles has remarkably increased durability. Briefly, the durability of electric contact material for operation of a magnetic clutch (i.e., inductive clutch) of a vehicle air-conditioner is determined by the type of wear to which the contact material is subjected.

In general, there are two types of wear of electric contact material for use in vehicles employing a power source (DC 14 V); (1) the case in which a positive electrode material is worn by a metal phase arc, thereby dispersing the formed powder around the contact material and (2) the case in which a negative electrode material is worn by a metal phase arc and a subsequently generated gas phase arc, thereby dispersing the formed powder around the contact material and transferring a material from the negative electrode to a positive electrode.

In practical applications, the type of wear of electric contact material for operating lamps (i.e., loads) such as head lamps and resistance (i.e., a load) (rear defogger i.e., resistance heating wire for defogging a rear window of a vehicle) is known to be categorized as case (1), whereas the type of wear of electric contact material for operating inductive loads such as a magnetic clutch of a vehicle air-conditioner is known to be categorized as case (2).

The present inventors have conducted studies on Ag—containing electric contact material useful in the fabrication of a relay for use in vehicles for operation of elements (i.e., loads) where the type of wear associated with case (2) manifests itself, and have found that when the material is used in an open system, arcs are focused on a certain portion of the electric contact, thereby forming projections and craters on a contact surface during an initial stage of make-and-break operation. Once such projections and craters have been formed, arcs are further focused on the projections, thereby accelerating the growth of projections and craters. The growth of projections and craters reduces the contact gap (minimum distance between contact parts), thereby prolonging the period during which the arc continues. This in turn further promotes the formation of projections and craters, thereby accelerating the deterioration of the electric contact. Finally, the contact attains a locking state (projections and craters are mechanically locked together) which causes malfunctions in the apparatus containing such an electric contact or readily causes self-welding thereof. Since these projections are formed through transfer of a material from a negative electrode to a positive electrode, the projections have an oxide-poor (loss of oxide) metallographic structure as compared with the initial state of the contact material. The welding resistance of such electric contact materials depends on the amount of oxide contained in the materials. Thus, projections containing a lesser amount of oxide exhibit low welding resistance, thereby readily undergoing self-welding.

On the basis of the results of the above research, the present inventors have investigated the composition electric contact material and the circumstance under which the materials are used, and have proposed the use of the electric contact material as recited in claim 1 or 2 in a shielded space so as to inhibit formation of projections and craters during an initial stage of make-and-break operation. The inventors have further elucidated that the durability can be enhanced stably by filling the shielded space with a gas other than an oxygen-containing gas such as air; i.e., with an oxygen-free gas. Also, the inventors have confirmed that is a preferred oxygen-free gas in actual practice argon or nitrogen.

The reason why the electric contact material according to the present invention useful in the fabrication of a relay for use in vehicles can prevent formation of projections and craters during an initial stage of make-and-break operation is considered to be due to the following mechanism.

In general, when an Ag— containing electric contact material is used in an open-type relay for use in vehicles, a metal phase arc is generated at a contact surface by breaking the contact, and a subsequently generated gas phase arc forms a molten portion in Ag. Since the solubility limit of oxygen in molten Ag is 0.32 wt. % (960.5° C.), molten Ag immediately takes in oxygen to form a solid solution. Subsequently, molten Ag begins to solidify through heat diffusion while in contact with a non-molten portion. Since the solubility limit of oxygen in Ag solid is considerably low (0.01 wt. % at 939° C.) as compared with the case of molten Ag), a certain amount of oxygen which cannot be dissolved is released from Ag solid in the form of oxygen gas. In this case, Ag solidifies into foam-like Ag solid containing bubbles. Then, when the relay operates, another arc is generated at a portion where the Ag solid has acquired this foam-like form. Subsequently, foamed Ag is then transferred from a negative electrode to a positive electrode through the action of a gas phase arc and is deposited on the surface of the positive electrode. Repetition of the process results in the formation of projections and craters on a contact portion.

However, since the electric contact material according to the present invention useful in the fabrication of a relay for use in vehicles is used in a shielded space, the aforementioned foaming of Ag and concentration of arcs are prevented, thereby inhibiting formation of projections and craters. Thus, the durability of the electric contact material can be remarkably enhanced.

The electric contact material according to the present invention useful in the fabrication of a relay for use in vehicles comprises an Ag-base material. The effects of incorporation of other component elements; i.e., Sn, In, and Ni, and the reason why the amount of each element has been determined will be described hereunder.

The element Sn is contained in the electric contact material in the form of $SnO_2$. Sn contributes to enhancement of welding resistance of the electric contact material for operation of loads, such as a lamp load, in which there is a flow of inrush current. The amount of Sn is limited to 5.0–10.0 wt. % for the following reasons. Briefly, when the amount is less than 5.0%, the electric contact material useful in the fabrication of a relay for use in vehicles cannot maintain an acceptable level of welding resistance. Particularly, this tendency is more clear in the case of operation of a lamp (i.e., a load). When the amount is in excess of 10.0 wt. %, processability of the contact material decreases, thereby affecting the production of electric contacts. When the electric contact material is employed in a shielded space for operating a magnetic clutch (i.e., a load) of a vehicle air-conditioner, an amount of Sn of 6.5–9.0 wt. % is particularly preferred, in view of electric contact characteristics.

The element In is contained in the electric contact material in the form of $In_2O_3$. The In contributes to enhancing wear resistance of the electric contact material used to operate a magnetic clutch (i.e., an inductive load) of a vehicle air-conditioner. The amount of In is limited to 2.0–5.0 wt. % for the following reasons. Briefly, when the amount is less than 2.0 wt. %, the electric contact material has poor wear resistance during operation of a magnetic clutch (i.e., an inductive load) of a vehicle air-conditioner, thereby failing to attain an acceptable level of durability. When the amount is in excess of 5.0 wt. %, the high cost of In disadvantageously elevates the product price. When the electric contact material is employed in a shielded space for operating a magnetic clutch (i.e., a load) of a vehicle air-conditioner, an amount of In of 3.6–4.5 wt. % is particularly preferred, in view of electric contact characteristics.

Ni serves as an element for depositing oxide micrograms in Ag during internal oxidation to form Ag—$SnO_2$—$In_2O_3$ alloys and enhances welding resistance and wear resistance of electric contact material. The amount of Ni is limited to 0.01–0.50 wt. % for the following reasons. Briefly, when the amount is less than 0.01 wt. %, the effect of depositing oxide micrograms cannot be attained, whereas when the amount is in excess of 0.50 wt. %, Ag and Ni assume two separate phases in a molten state, thereby causing segregation of Ni during casting, possibly leading to a problem in product quality. When the electric contact material is employed in a shielded space for operating a magnetic clutch (i.e., a load) of a vehicle air-conditioner, an amount of Ni of 0.05–0.20 wt. % is particularly preferred, in view of electric contact characteristics.

Needless to say, use of the electric contact material according to the present invention in a shielded space attains a durability at least twice that of conventional electric contact material useful in the fabrication of a relay for use in vehicles, the relay controlling a magnetic clutch (i.e., a load) of a vehicle air-conditioner.

BEST MODES FOR CARRYING OUT THE INVENTION

Figure 1:
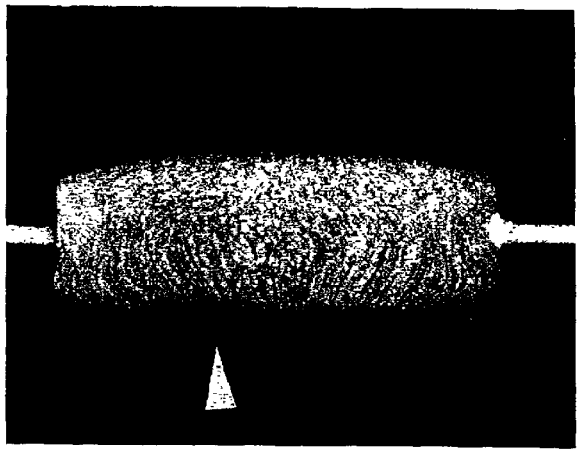
FIG. 1 is a photograph of an observed cross-section of a movable contact taken from a relay having undergone a durability test of 2,000,000 cycles of make-and-break operation carried out in Working Example 7.

One embodiment for carrying out the present invention will next be described by way of the below-described Working Examples 1 to 8. In Working Examples 1 to 8, shielded-type relays were fabricated from the electric contact materials having compositions shown in Table 1. In Referential Examples 1 to 8 shown in Table 1, open-type relays were fabricated from the electric contact materials having compositions similar to those employed in Working Examples 1 to 8.

TABLE 1

| | Composition before internal oxidation | Type of relay |
|---|---|---|
| Example 1 | Ag - 6.5% Sn - 4.0% In | shielded |
| Example 2 | Ag - 6.5% Sn - 4.0% In - 0.2% Ni | shielded |
| Example 3 | Ag - 8.0% Sn - 4.0% In | shielded |
| Example 4 | Ag - 6.0% Sn - 3.6% In | shielded |

TABLE 1-continued

| | Composition before internal oxidation | Type of relay |
|---|---|---|
| Example 5 | Ag - 6.5% Sn - 4.0% In - 0.1% Ni | shielded |
| Example 6 | Ag - 7.0% Sn - 5.0% In - 0.2% Ni | shielded |
| Example 7 | Ag - 8.0% Sn - 4.0% In - 0.2% Ni | shielded |
| Example 8 | Ag - 6.0% Sn - 3.6% In - 0.2% Ni | shielded |
| Ref. Ex. 1 | Ag - 6.5% Sn - 4.0% In | open |
| Ref. Ex. 2 | Ag - 6.5% Sn - 4.0% In - 0.2% Ni | open |
| Ref. Ex. 3 | Ag - 8.0% Sn - 4.0% In | open |
| Ref. Ex. 4 | Ag - 6.0% Sn - 3.6% In | open |
| Ref. Ex. 5 | Ag - 6.5% Sn - 4.0% In - 0.1% Ni | open |
| Ref. Ex. 6 | Ag - 7.0% Sn - 5.0% In - 0.2% Ni | open |
| Ref. Ex. 7 | Ag - 8.0% Sn - 4.0% In - 0.2% Ni | open |
| Example 8 | Ag - 6.0% Sn - 3.6% In - 0.2% Ni | open |

Each of the electric contact materials of Working Examples 1 to 8 and Referential Examples 1 to 8 was produced by use of a typically employed high-frequency induction furnace. Specifically, an Ag alloy having a corresponding composition was melted and cast into an ingot, which was then hot-extruded to form a wire rod (ϕ=6 mm). The thus-formed wire rod was drawn, thereby forming a wire rod (ϕ=2 mm). The formed rod was cut to prepare chips having dimensions of ϕ2 mm×2 mmL. The chips were internally oxidized for 48 hours at an oxygen pressure of 5 atm and a temperature of 750° C. The thus-treated chips were collected and compacted, to thereby form a columnar billet (ϕ=50 mm).

After completion of compaction, the billet was sintered at 850° C. for 4 hours. The cycle of compaction and sintering was repeatedly performed four times.

The thus-pressed and -sintered billet was hot-extruded to form a wire rod (1=7 mm) (extrusion ratio by areas approximately 51:1), followed by drawing, to thereby form a wire rod (ϕ=2.0 mm). The wire rod was processed in a header machine, to thereby prepare rivet contacts having a head diameter of 2.8 mm and a head thickness of 0.6 mm.

The thus-prepared rivet contacts were incorporated into a shield-type relay for the Working Examples and in an open-type relay for the Referential Examples. The durability test for simulating the operation of a magnetic clutch (i.e., a load) of a vehicle air-conditioner was performed under the conditions shown in Table 2. This durability test was performed by use of at least four relays, and the number of make-and-break operations required to break a first relay was counted. Except for Working Example 7, the test was terminated when none of the relays had broken after more than 1,000,000 cycles of make-and-break operation, and the number indicating durability was represented by "≧1,000,000 cycles." In working Example 7, the test was performed for up to 2,000,000 cycles of make-and-break operation. The results of the durability test are shown in Table 3.

TABLE 2

| | |
|---|---|
| Voltage | 14 V |
| Current | constant 4.3 A |
| Load power | 50 W |
| Operation frequency | 0.5 seconds ON/2.5 seconds OFF |
| Temperature at test | 85° C. |

TABLE 3

| | Durability (No. of make-and-break operations) | | Durability (No. of make-and-break operations) |
|---|---|---|---|
| Example 1 | ≧1,000,000 | Ref. Ex. 1 | 450,000 |
| Example 2 | ≧1,000,000 | Ref. Ex. 2 | 480,000 |
| Example 3 | ≧1,000,000 | Ref. Ex. 3 | 500,000 |
| Example 4 | ≧1,000,000 | Ref. Ex. 4 | 380,000 |
| Example 5 | ≧1,000,000 | Ref. Ex. 5 | 400,000 |
| Example 6 | ≧1,000,000 | Ref. Ex. 6 | 550,000 |
| Example 7 | ≧2,000,000 | Ref. Ex. 7 | 540,000 |
| Example 8 | ≧1,000,000 | Ref. Ex. 8 | 420,000 |

The results of the test shown in Table 3 reveal that the electric contact materials having the compositions according to the present invention have the following characteristics. Specifically, the test confirmed that all the electric contact materials employed in Working Examples 1 to 8 had a durability of 1,000,000 cycles or more when the materials were employed for controlling a magnetic clutch (i.e., a load) of a vehicle air-conditioner. In contrast, it was confirmed that the electric contact materials employed in the Referential Examples; i.e. open-type relays, resulted in the first breakage of a relay at less than 540,000 cycles of make-and-break operation, and that the target durability; i.e., 1,000,000 or more cycles, was not attained.

In Working Examples 2 and 7, the durability test was performed while a lamp was used as a load. In this case, the test was also performed by use of at least four relays, and the number of make-and-break operations required to break the first relay was counted. When none of the relays had broken through over twice the target number of make-and-break operations, the test was terminated, and the number indicating durability was represented by "more than twice the target number." The results of the durability test using a lamp (i.e., a load) are shown in Table 4.

TABLE 4

| Loads | Target durability | Durability (No. of make-and-break operations) Example 2 | Example 7 |
|---|---|---|---|
| Lamp (240 W) | 100,000 | ≧200,000 | ≧200,000 |
| Lamp (120 W) | 200,000 | ≧400,000 | ≧400,000 |
| Resistor (240 W) | 100,000 | ≧200,000 | ≧200,000 |

The results shown in Table 4 reveal that the electric contact materials employed in Working Examples 2 and 7 have excellent durability; i.e., twice the target durability represented by the number of make-and-break operations where a lamp (i.e., a load) was used.

Figure 2:
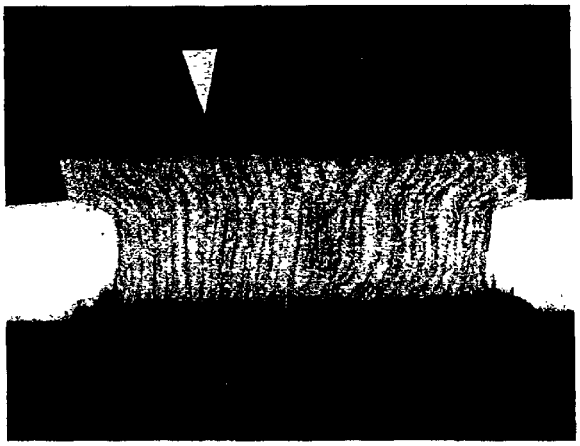
FIG. 2 is a photograph of an observed cross-section of a fixed contact taken from a relay having undergone a durability test of 2,000,000 cycles of make-and-break operation carried out in Working Example 7.
Figure 3:
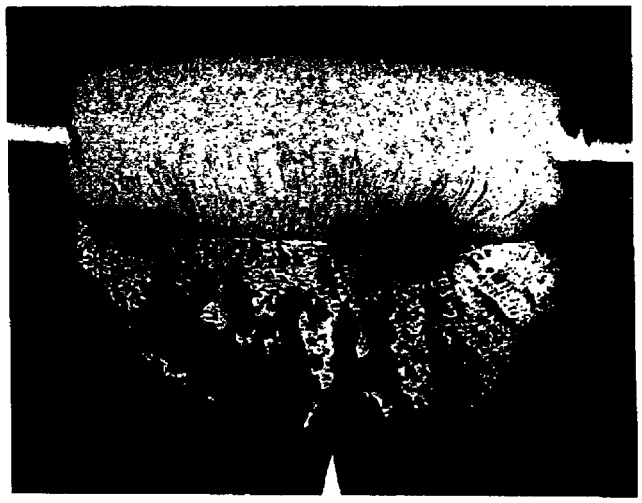
FIG. 3 is a photograph of an observed cross-section of a movable contact taken from a relay having undergone a durability test of 800,000 cycles of make-and-break operation carried out in Referential Example 7.
Figure 4:
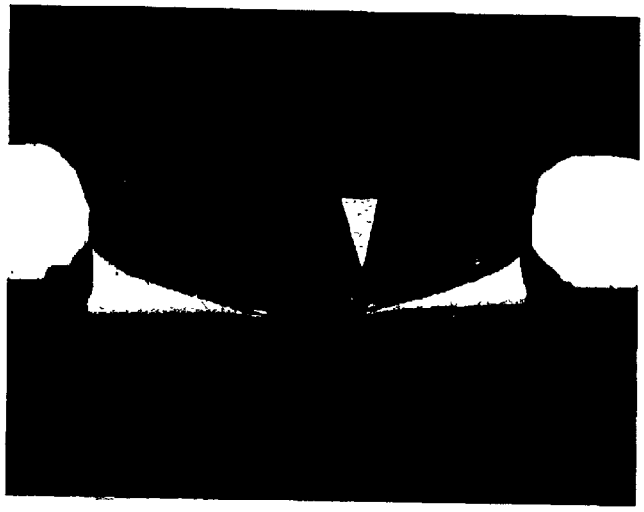
FIG. 4 is a photograph of an observed cross-section of a fixed contact taken from a relay having undergone a durability test of 800,000 cycles of make-and-break operation carried out in Referential Example 7.

Finally, the conditions of electric contacts employed in the relays were observed after the relays for controlling a magnetic clutch (i.e., a load) of a vehicle air-conditioner had been subjected to the durability test. The results are shown hereunder. FIGS. 1 and 2 are photographs showing a cross-section (magnification: ×25) of a movable-side contact and that of a fixed-side contact removed from a relay which exhibited a durability of 2,000,000 cycles in the durability test of relays produced from the contact material of Working Example 7. FIGS. 3 and 4 are photographs showing a cross-section (magnification: ×25) of a movable-side contact and that of a fixed-side contact removed from a relay which exhibited a maximum durability of 800,000 cycles in the durability test of relays produced from the contact material of Referential Example 7.

As is clear from the photographs showing a cross-section of the electric contacts, a foamed portion is identified in the cross-section of the movable-side contact in the open-type relay produced from the contact material of Referential Example 7, even though the relay has the highest durability in the Referential Examples. In the corresponding fixed-side contact, transfer of the contact material and a crater-like cross-sectional view are observed. In contrast, the shielded-type relay of Working Example 7 shows no deformation of the electric contact shown in the relay of Referential Example 7.

Industrial Applicability

The electric contact material according to the present invention is useful in the fabrication of a highly durable relay for use in vehicles, the relay controlling a magnetic clutch (i.e., a load) of a vehicle air-conditioner. Thus, the contact material can greatly prolong the service life of relays for use in vehicles. When used to control other loads, such as a lamp, the contact material also shows durability equal to that conventionally attained. The contact material is suitable for extending applications of the material and reducing the size of apparatus using the material.

What is claimed is:

1. An automotive relay comprising an automotive relay controlling a load, said load generated when a magnetic clutch of a vehicle air-conditioner is operated, wherein the relay comprises a hermetically shielded space inhibiting free entry of oxygen and an electric contact material within said space, the electric contact material consisting essentially of an Ag—$SnO_2$—$In_2O_3$ alloy which is produced through internal oxidation of an Ag—Sn—In alloy containing 5.0–10.0 wt. % Sn, and 2.0–5.0 wt. % In, the balance being Ag.

2. An automotive relay comprising an automotive relay controlling a load, said load generated when a magnetic clutch of a vehicle air-conditioner is operated, wherein the relay comprises a hermetically shielded space inhibiting free entry of oxygen and an electric contact material within said space, the electric contact material consisting essentially of an Ag—$SnO_2$—$In_2O_3$—NiO alloy which is produced through internal oxidation of an Ag—Sn—In—Ni alloy containing 5.0–10.0 wt. % Sn, 2.0–5.0 wt. % In, and 0.01–0.50 wt. % Ni the balance being Ag.

* * * * *